United States Patent [19]

Johnston et al.

[11] 4,227,056

[45] Oct. 7, 1980

[54] KEY LOCK ROTARY SELECTOR SWITCH

[75] Inventors: Robert J. Johnston, Beaver Falls; Stephen G. Layciak, Brighton Township, Beaver County; Dominic Colista, Harmony Township, Beaver County, all 1f, Pa.

[73] Assignee: Westinghouse Electric Corp., Pittsburgh, Pa.

[21] Appl. No.: 29,515

[22] Filed: Apr. 12, 1979

[51] Int. Cl.[3] ..... H01H 9/28

[52] U.S. Cl. ..... 200/44; 200/42 R; 200/4; 200/153 L

[58] Field of Search ..... 200/42, 44, 16 A, 153 L, 200/316, 336, 4

[56] References Cited

U.S. PATENT DOCUMENTS

| | | | |
|---|---|---|---|
| 2,498,614 | 2/1950 | Tregoning | 200/4 |
| 2,669,616 | 2/1954 | Frank | 200/44 |
| 2,748,210 | 5/1956 | Frank | 200/44 |
| 2,803,716 | 8/1957 | Nolden et al. | 200/44 |
| 3,497,644 | 2/1970 | Schink et al. | 200/11 |
| 3,917,919 | 11/1975 | Taharn | 200/44 |
| 4,000,382 | 12/1976 | Kolb | 200/153 L |
| 4,009,357 | 2/1977 | Naylor | 200/42 R |
| 4,052,582 | 10/1977 | Mullen et al. | 200/16 A |
| 4,175,220 | 11/1979 | Johnston et al. | 200/153 L |
| 4,175,221 | 11/1979 | Kellogg | 200/4 |

*Primary Examiner*—John W. Shepperd
*Attorney, Agent, or Firm*—L. P. Johns

[57] ABSTRACT

A key lock rotary selector switch characterized by a switch structure and a rotatable operating unit; the switch structure having a reciprocable contact operating member for effecting opening and closing of a circuit through the switch; the operating unit comprising an actuator tube and a rotatable handle detachably connected to the tube, and an actuator cam for different modes of operating the switch; and a lock in the handle for locking the handle in a given mode of operation.

5 Claims, 16 Drawing Figures

FIG. 9
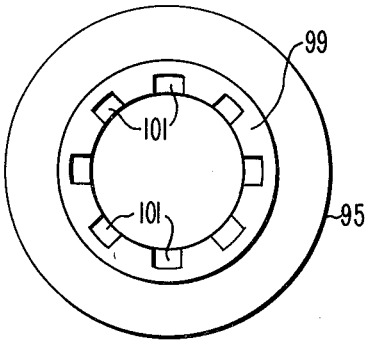
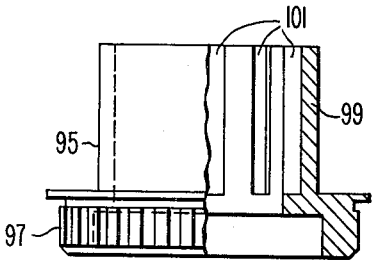
FIG. 5
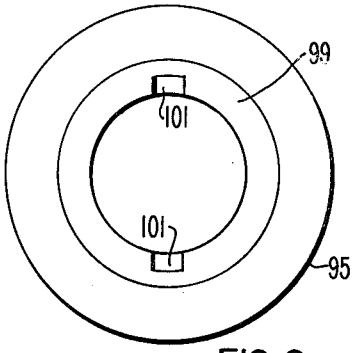
FIG. 6
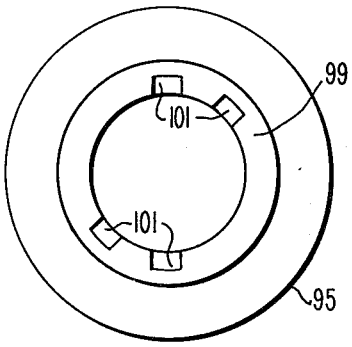
FIG. 7
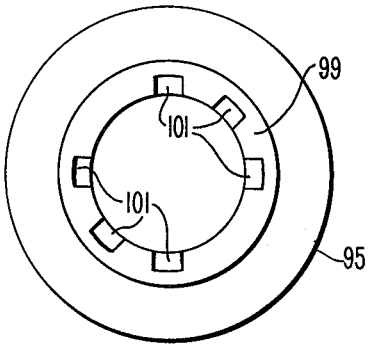
FIG. 8

KEY LOCK ROTARY SELECTOR SWITCH

CROSS-REFERENCE TO RELATED APPLICATIONS

This invention relates to copending applications of W. J. Kellogg, Ser. No. 858,326, now U.S. Pat. No. 4,175,221 filed May 2, 1977, Robert J. Johnston et al., Ser. No. 858,323, now U.S. Pat. No. 4,175,220 filed Dec. 7, 1977, and R. J. Johnston et al., Ser. No. 858,325, filed Dec. 7, 1977.

BACKGROUND OF THE INVENTION

1. Field of the Invention

This invention relates to a rotary selector switch of the type having a key lock.

2. Description of the Prior Art

Most rotary selector switches of prior construction include the capability of a number of modes of operation. Moreover, they have been used in combination with key locks for a variety of key-out or locked positions. A disadvantage, however, of most such key lock switches has been a requirement of a plurality of different operating parts for each mode of operation. An example of control switch operators is disclosed in U.S. Pat. Nos. 2,748,210, 3,497,644, and 4,009,357.

SUMMARY OF THE INVENTION

In accordance with this invention, a key lock rotary selector switch is provided which comprises a switch structure and a rotatable operating unit; the switch structure having a reciprocable contact operating member to effect opening and closing of a circuit through the switch; the unit including a tubular housing, an actuator tube within the housing and being operable against the operating member, a handle operatively connected to the actuator tube, connecting means for connecting the handle to the actuator and including a bushing fixedly mounted within the housing, a lock plug rotatably mounted within the bushing, interlock means between the lock plug and the actuator for interchangeably positioning the plug and actuator and comprising an adaptor, the plug and adaptor having detachable first interfitting means for rotating the handle through one limited sector thereof, the actuator and the adaptor having detachable second interfitting means for rotating the actuator through another limited sector thereof, the first and second interfitting means being repositionable for rotation of the handle and actuator through other limited sectors; stop means comprising a radial arm on the adaptor and a rib on the housing and in the path of rotation of the arm for limiting rotation of the actuator; the first interfitting means comprising an off-center projection on one of the plug and adaptor and a projection-receiving notch in the other thereof; the second interfitting means comprising the radial arm and an arm-receiving notch in the actuator; the lock plug having a key actuated contractable latch laterally movable in response to movement of a key; and the bushing having peripherally spaced opening means for receiving the latch, whereby the handle is locked in place when a key is removed from the lock plug.

The advantage of the key lock selector switch of this invention is that it incorporates a lock by which a circuit can be selected and locked on or off as desired from a combination of two, three, or four positions with the multiple number of circuits available in each position, thereby offering a wide variety of switching sequences.

BRIEF DESCRIPTION OF THE DRAWINGS

FIG. 5 is a sectional view, partly in elevation, of the bushing;

FIGS. 6, 7, 8 and 9 are plan views of various embodiments of the bushing which embodiments comprise two, four, six and eight broach slots for switch positions ranging from one to four positions;

DESCRIPTION OF THE PREFERRED EMBODIMENTS

Figure 1:
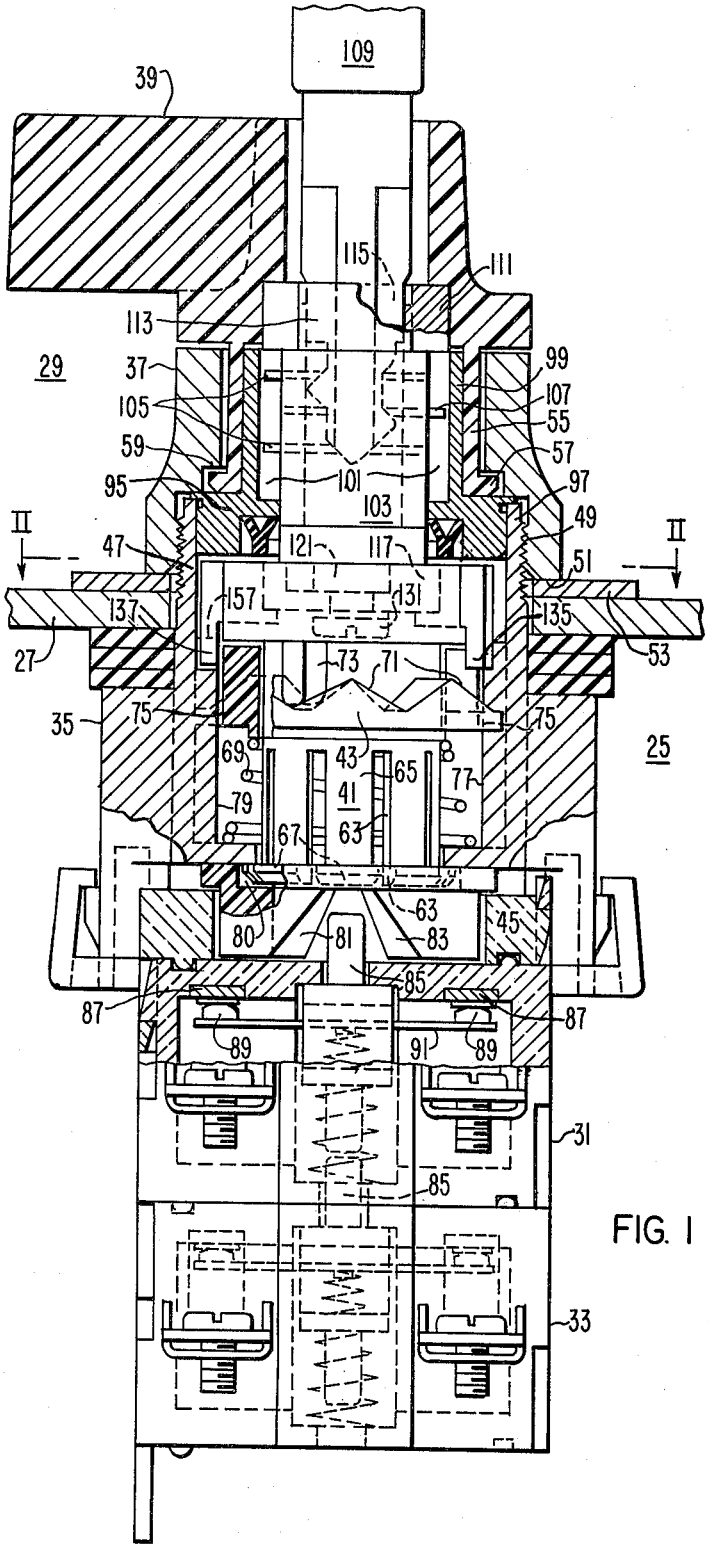
FIG. 1 is a vertical sectional view, embodying the principles of this invention.

In FIG. 1 a switch is generally indicated at 25 and is mounted on a panel 27. The switch 25 comprises an operating unit 29 and pairs of contact blocks or switches 31, 33 in tandem. The operating unit 29 comprises a housing 35, a clamp ring 37, a handle 39, an actuator tube 41, a detent cam 43, and an operating cam 45. The housing 35 is a tubular member including a reduced portion 47 which extends through an aperture in the panel 27 and which comprises a threaded upper end portion 49 on which the clamp ring 37 is tightened for engagement with the panel at 51. A nameplate is disposed on the panel, around the housing 35, and under the clamp ring 37.

The handle 39 comprises an electrically insulating material and includes a portion 55 which is detachably mounted on the upper end of the clamp ring by means of a peripheral flange 57 engaging an annular shoulder 59 on the ring.

The actuator 41 has an upper end portion which is annular and comprises a radial flange 61, as well as a lower portion which comprises a plurality of radially spaced grooves or slots 63 that form a number of longitudinal members 65, the lower ends of which include out-turned flanges 67. The detent cam 43 is annular and is mounted on the lower portion of the contact actuator tube where it is movable against a coil spring 69 between the actuator in the housing 35. The detent cam 43 includes a plurality of spaced cam notches 71 in which a pair of diametrically opposite tube projections 73 (one of which is shown) operate. The detent cam 43 also includes a pair of diametrically opposite grooves 75 in which opposite cam guides 77, 79 (FIGS. 2, 3, 4) are located, which guides extend longitudinally on the internal surface of the housing 35 and enable the detent cam to move longitudinally without rotating.

The operating cam 45 is mounted on the lower end of the actuator 41. The operating cam 45 is annular with cam surfaces 81, 83 for actuating a reciprocable contact operating member or plunger 85 of the contact blocks 31, 33. Inasmuch as the contact blocks 31, 33 are disclosed more particularly in an application entitled "Convertible Selector Switch" of R. G. Johnston, Ser.

No. 838,523, filed Dec. 7, 1977, a brief description of the contact blocks is included herein. The contact blocks 31, 33 comprising similar plungers 85 each include a pair of spaced stationary contacts 87 and a pair of movable contacts 89, the latter of which are mounted on a rigid, spring loaded contact carrier 91. The contact carrier 91 is supported centrally on the plunger 85.

Figure 15:
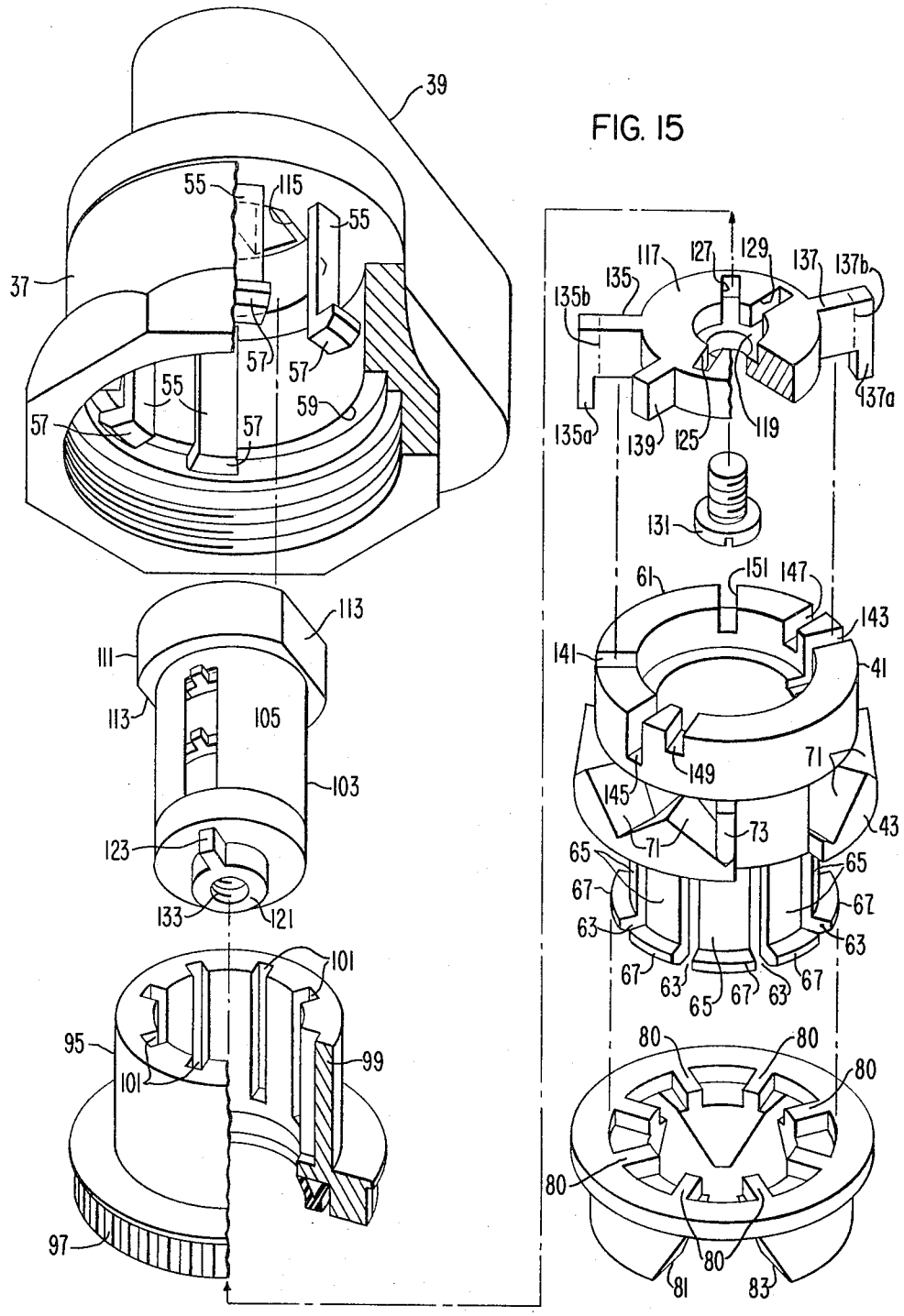
FIG. 15 is an exploded view.
Figure 16:
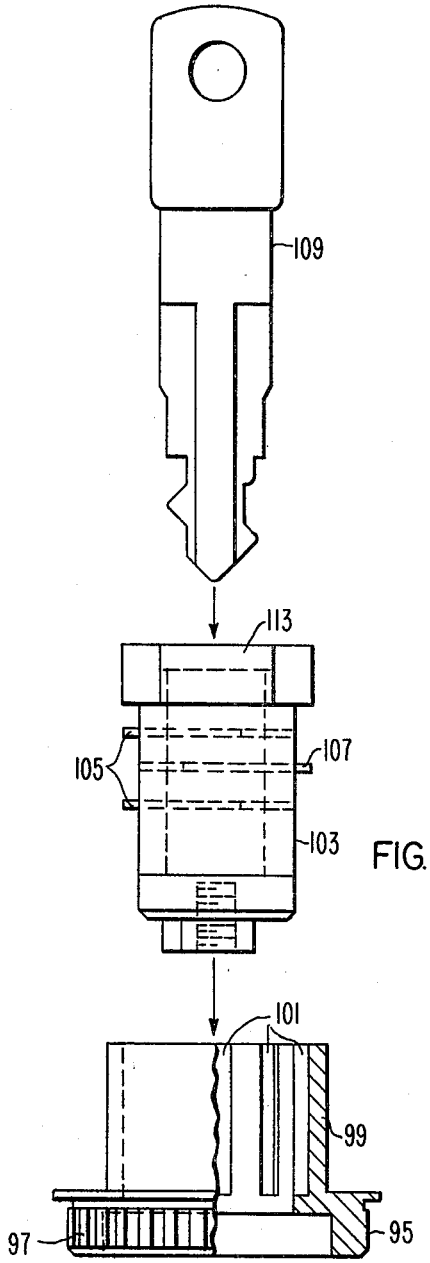
FIG. 16 is an exploded view.

The cam 45 is detachably mounted on the lower end of the actuator by a plurality of spaced spokes 80 (FIG. 15) which are seated in the slots 63, thereby enabling rotation of the cam in response to rotation of the actuator 41.

In accordance with this invention the handle 39 including the longitudinal portions 55 is seated on a bushing 95 having a peripheral surface 97 which is pressfitted into the inner periphery of the reduced portion 47 of the housing. The bushing includes a reduced portion 99 which has a plurality of spaced broach slots 101 (FIG. 9). The reduced portion extends upwardly and within the portion 55 of the handle 39. The number of broach slots 101 is variable (FIGS. 6, 7, 8, 9) depending upon the number of key-out locked positions ad described below. Suffice it to say, the broach slots are disposed in diametrically opposite positions.

Figure 10:
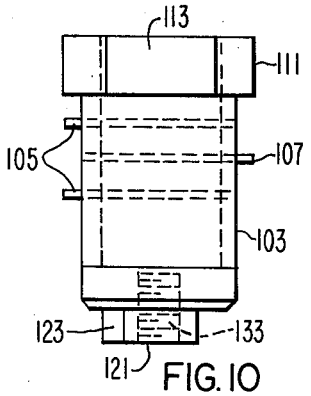
FIG. 10 is a plan view of the lock plug.
Figure 11:
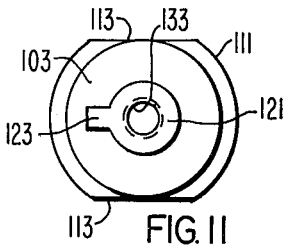
FIG. 11 is a bottom end view of the lock plug.

A lock plug 103 (FIGS. 1, 10, 11) is disposed within the bushing 95 and includes a row of tumblers 105 along one side and another row of tumblers 107 on the diametrically opposite side which tumblers engage diametrically opposite broach slots 101 in the bushing 95. When the key 109 is in place in the locked plug 103, the tumblers 105, 107 are retracted into the locked plug so that the handle 39 may be rotated and the operating cam 45 thereby rotated to a desired position of the contacts 87, 89. Manifestly, when the key 109 is removed the tumblers are in extended positions within a particular pair of slots 101. Thus, with the key removed the handle 39 cannot be rotated, and conversely, the key cannot be removed when no slots are provided.

Moreover, the number of positions in which the handle 39 is locked in position is dependent upon the number of pairs of slots 101 in the bushing 95. Where one pair of bushings (FIG. 6) is provided the handle 39 can be locked in only one position when the key is removed. Likewise, where two slots 101 (FIG. 7) or three or four pairs of slots 101 (FIGS. 8 and 9) are provided, the key 109 may be removed in three or four locked positions. The upper end of the lock plug 103 (FIGS. 10, 11) includes a flange 111 having a pair of flat surfaces 113 on diametrically opposite sides of the plug. The handle 39 comprises a recess having parallel flat surfaces 115 corresponding to and keying with the flat surfaces 113 of the plug 103, whereby the handle 39 and the plug 103 are rotatable or locked together.

In accordance with this invention the switch 25 also comprises interlock means between the plug 103 and the actuator 41 for interchangeably positioning the plug and the actuator for rotating the actuator tube through two, three, or four switch positions. For that purpose an adaptor 117 is disposed between the lower end of the plug 103 and the upper end of the actuator 41. The adaptor 117 (FIG. 15) comprises a hole 119 in which a projection 121 of the plug 103 is seated. A radial detent 123 extends outwardly from the projection and fits into one of three grooves 125, 127, 129. When assembled a screw 131 (FIG. 1) extends through the hole 119 and into a tapped hole 133 in the projection 121, thereby holding the adaptor 117 in place on the lower end of the plug 103.

Figure 12:
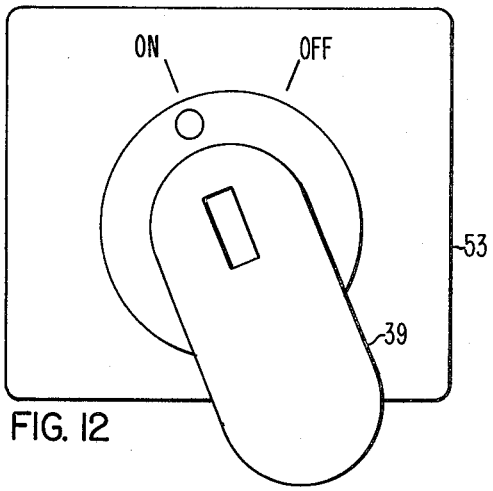
FIGS. 12, 13 and 14 are elevational views of various legend plates with which the handle is used to indicate two, three and four modes of switch functions.
Figure 13:
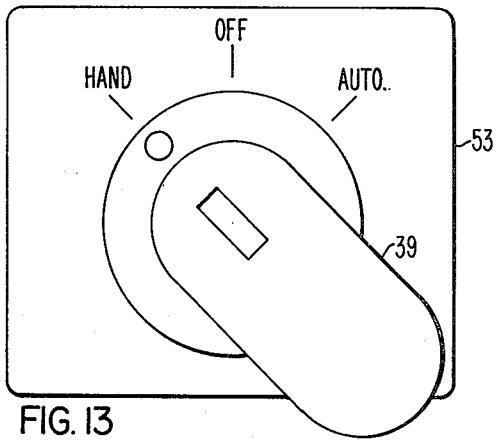
Figure 14:
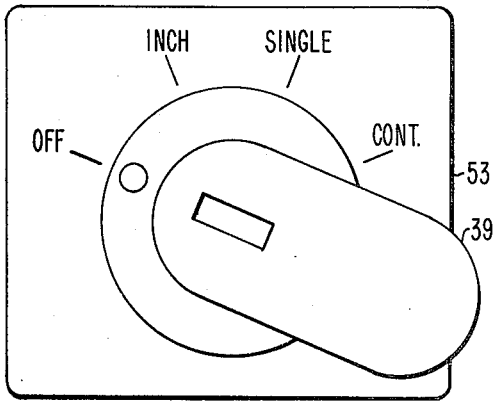

The adaptor 117 (FIG. 15) also comprises three radially extending arms 135, 137, 139 which arms are disposed in corresponding sets of notches 141, 143, 145, 147, 149, and 151 in the upper end of the actuator 41. As shown more particularly in FIGS. 2, 3 and 4, various combinations of assembly of the detent 123 in grooves 125, 127, 129 and of arms 135, 137, 139 in the notches 141–151 provide for movement of the handle 39 in various combinations of positions, including and coincident with the two, three, and four positions as indicated in FIGS. 12, 13, 14. Where the switch 25 functions in two positions (FIG. 2) the handle 39 rotates between positions 1 and 2 on equal sides of a vertical line 153 through a 45 degree arc 155. For that purpose the detent 123 is located in the groove 129 with the arms 135, 137, 139 disposed in appropriate notches 141, 151. With the handle 39 in position 1, the projections 73 are against the cam guides 77, 79. Upon rotation of the handle 39 to position 2 a down-turned portion **135*a* (FIG. 15) abuts the guide 77 as shown in the broken line position 135*a* (2) whereby the handle may be rotated between ON and OFF positions (FIG. 12**).

Figure 2:
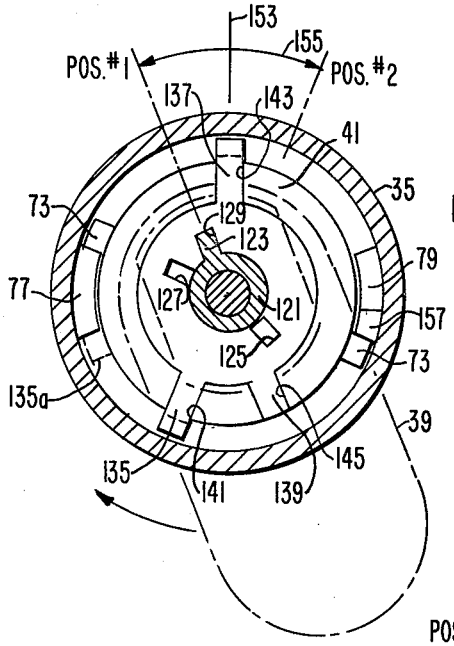
FIGS. 2, 3, and 4 are horizontal sectional views taken on the line II—II of FIG. 1, showing the various combinations of interfitting parts available for providing either two, three, or four switch positions.
Figure 3:
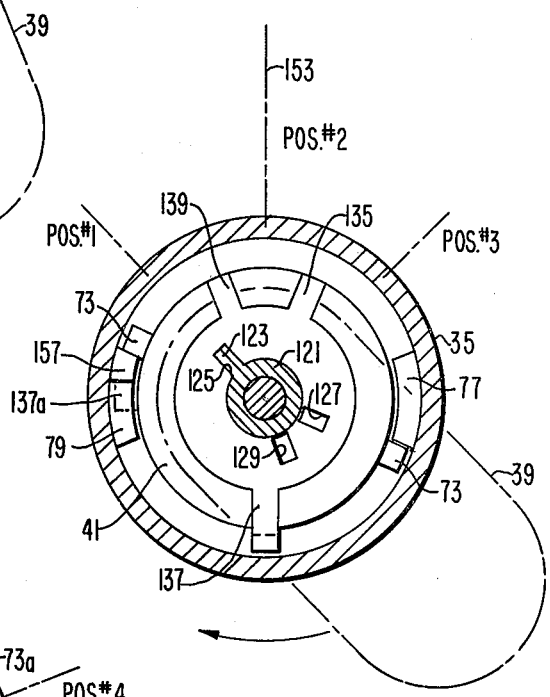
Figure 4:
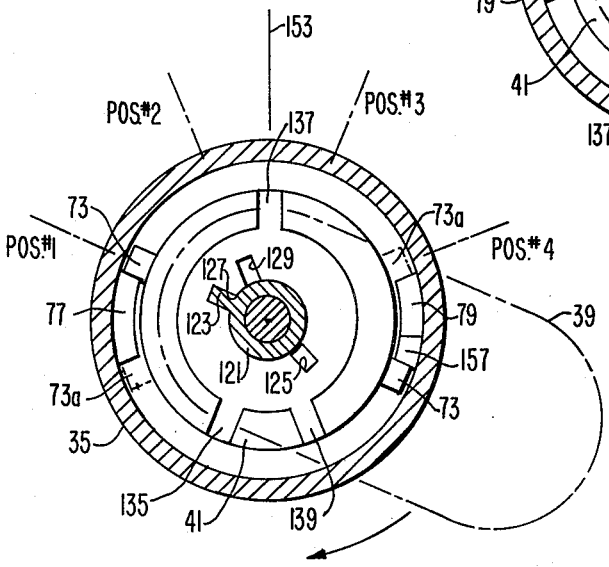

Similarly, in FIG. 3 the handle 39 is rotated through 45 degrees between each of the three positions. For three position operation the detent 123 is located in the groove 125 and the arms 135–139 now with **135*a* removed are disposed in appropriate notches 141–151 of the actuator 41. Moreover, in order to maintain the handle 39 in the conventional position of rotation about a vertical line 153, the housing 35 is rotated 180 degrees so that the guides 77, 79 are in opposite positions from those shown in FIG. 2 whereby a projection 157, which extends above the upper end of the guide 79, which upper end is aligned with the upper end of the guide 77, is disposed in the path of the arm portion 137*a*. As a result, the handle 39 is rotated between the three positions as limited by the projection 157 when engaged on one side by the arm 137 and on the other side by the projection 73 in position 73*a*. Thus, the switch is moved between three positions having designations HAND, OFF, and AUTO on a plate 53**.

For four position operation the handle is preferably rotated about a vertical line 153 (FIG. 4) with the cam guides 77, 79 in the same position as shown for the two position layout (FIG. 2). The detent 123 is disposed in the slot 127 and the arms 135, 137, 139 are disposed in appropriate notches 141, 151. However, the portions **135*a* and 137*a* of the arms 135, 137 are removed along zones 135*b* and 137*b* (FIG. 15), whereby the arms 135, 137 are shorter and enable the projections 73 to be rotated between the cam guides 77, 79 to the broken line positions 73*a* thereof. Accordingly, the handle 39 is rotated through four positions such as OFF, INCH, SINGLE, and CONTINUOUS as denoted on a legend plate 53**.

In conclusion, the switch handle 39 may be locked in any of the one, two, three, four positions, or all by providing the appropriate number of pairs of broach slots 101 in the bushing 95. Locking of the handle in that position is accomplished simply by placing the handle in the position and removing the key, whereby the tumblers 105 are disposed in the appropriate broach slot.

Accordingly, the selector switch of this invention incorporates a lock which offers any combination of locked positions when the key is out of the lock; that is, the switch offers any combination of "key-out" positions desired. The switch also offers unlockable positions where the key cannot be removed and requires in fact, rotation to another position before the operator can be locked and key removed.

What is claimed is:

1. A key lock rotary selector switch comprising a switch structure and a rotatable operating unit; the switch structure having a reciprocable contact operating member to effect opening and closing of a circuit through the switch; the unit including a tubular housing, an actuator within the housing and being operable against the operating member, a handle operatively connected to the actuator, connecting means for connecting the handle to the actuator and including a bushing fixedly mounted within the housing, a lock plug rotatably mounted within the bushing, interlock means between the lock plug and the actuator for interchangeably positioning the plug and actuator and comprising an adaptor, the plug and adaptor having detachable first interfitting means for rotating the handle through one limited sector thereof, the actuator and the adaptor having detachable second interfitting means for rotating the actuator through one limited sector thereof, the first and second interfitting means being repositionable for rotation of the handle and actuator through other limited sectors; the lock plug having a key actuated contractable latch laterally movable in response to movement of a key; and the bushing having peripherally spaced opening means for receiving the latch, whereby the handle is locked in place when a key is removed from the lock plug.

2. The switch of claim 1 in which stop means are provided between the housing and the adaptor for limiting rotation of the actuator.

3. The switch of claim 2 in which the stop means comprises a radial arm on the adaptor and rib means on the housing and in the path of rotation of the arm.

4. The switch of claim 3 in which the first interfitting means comprises an offcenter projection on one of the plug and adaptor and a projection-receiving notch in the other thereof.

5. The switch of claim 4 in which the second interfitting means comprises the radial arm and an arm-receiving notch in the actuator.

* * * * *